United States Patent [19]

Sudo

[11] 4,034,504

[45] July 12, 1977

[54] DIRECTION CHANGING ELECTROMAGNETIC DEVICE FOR WHEELED TOYS

[76] Inventor: Shyohei Sudo, 1-18-5, Sumida, Sumida, Tokyo, Japan

[21] Appl. No.: 677,557

[22] Filed: Apr. 16, 1976

[30] Foreign Application Priority Data

May 22, 1975 Japan ..... 50-61189

[51] Int. Cl.[2] ..... A63H 30/04

[52] U.S. Cl. ..... 46/254

[58] Field of Search ..... 46/210, 253, 254, 255, 46/256, 251, 234, 235, 262, 263

[56] References Cited

U.S. PATENT DOCUMENTS 2,718,729 9/1955 Giardina ..... 46/253

*Primary Examiner*—F. Barry Shay
*Attorney, Agent, or Firm*—Walter Becker

[57] ABSTRACT

A direction changing device for moving toys to be operated by a wireless remote-control system, wherein an operating rod is laterally slidably disposed in parallel with a wheel shaft so as to be engaged with any one of a plurality of recessed portions formed in a disc concentrically fitted inside any one of the wheels at both ends of the wheel shaft, when the rod is caused to move in that direction by an energized electromagnet which attracts a movable iron piece connected with the operating rod. The wheel, the rotation of which is stopped by the engagement of the operating rod with the engaging disc, becomes a pivot for turning the body of the moving toy in any desired direction.

5 Claims, 3 Drawing Figures

DIRECTION CHANGING ELECTROMAGNETIC DEVICE FOR WHEELED TOYS

BACKGROUND OF THE INVENTION a. Field of the Invention

This invention is concerned with a steering device. More particularly, the present invention relates to a direction changing device in moving toys such as, for example, toy automobiles, etc., which can be steered, as desired, by a wireless remote-control system.

b. Description of Prior Arts

There have so far been proposed various kinds of devices for changing direction in moving toys which are controlled by a wireless remote-control steering means. However, such known device is constructed in such a manner that the rotation of the driving wheel of the moving toy is completely stopped, and the body of the moving toy is caused to move toward the lateral direction with the stopped driving wheel as the pivot point for turning, or the direction changing. Accordingly, the direction changing or steering of this type of moving toy has been performed by repetition of rotation and stoppage of the driving wheel, hence the mechanical construction of the device becomes inevitably complicated.

Therefore, the present invention paid particular attention to this disadvantageous point in the known direction changing device for such moving toys, and has developed an improved construction therefor, wherein the direction changing can be done without stopping the rotation of the driving wheel, which constitutes a remarkable and advantageous difference over the conventional direction changing device in the moving toys.

SUMMARY OF THE INVENTION

It is, therefore, the primarily object of the present invention to provide an improved new direction changing device for moving toys, wherein repetitive, alternate rotation and stoppage of the driving wheel is not required, whereby the manufacturing cost of the toy product can be made lower than that provided with the aforementioned complicated direction changing device of the known type.

According to the present invention, there is provided a direction changing device for moving toys which comprises in combination: a base plate, both end parts of which are bent upright, a wheel shaft or axle having wheels at both ends thereof, which passes through and is held by said upright end parts of said base plate in a rotatable manner, an engaging disc provided at the inside surface thereof with a plurality of recessed portions, and fixed concentricaly in one of said wheels so that said disc may not be rotated in idle, while the other wheel is made freely rotatable, an operating rod arranged in parallel with said wheel shaft in a laterally slidable manner through said upright end parts of said base plate so that one of the end parts thereof may be properly engaged with any one of said recessed portions in said engaging disc, when said operating rod is caused to move laterally, an electromagnet mounted on one part of said base plate, and a movable iron piece, one end of which is fixed on said other end of said operating rod, and the other end of which is oscillatably fitted in the vicinity of said electromagnet so as to cause the operating rod to shift sidewise, when it is attracted to and contacted with the iron core of said electromagnet, said base plate being oscillatably fitted on the body of said moving toy through a pivot pin to enable said toy to change its moving direction on the pivot of the wheel, the rotation of which has been hindered by the operating rod engaged at its one tip end with said recessed part of said engaging disc provided in one of the wheels, when said movable iron piece contacts the iron core of said electromagnet by a control signal emitted from the outside.

The foregoing object and other objects of the present invention as well as its detailed construction and function will be explained to the fullest extent in the following with reference to a preferred embodiment so that the invention may become more clearly understandable to those skilled in the art, when read in conjunction with the accompanying drawing, in which the same parts and components are designed with the same reference numerals.

DETAILED DESCRIPTION OF THE PREFERRED EMBODIMENT

Figure 1:
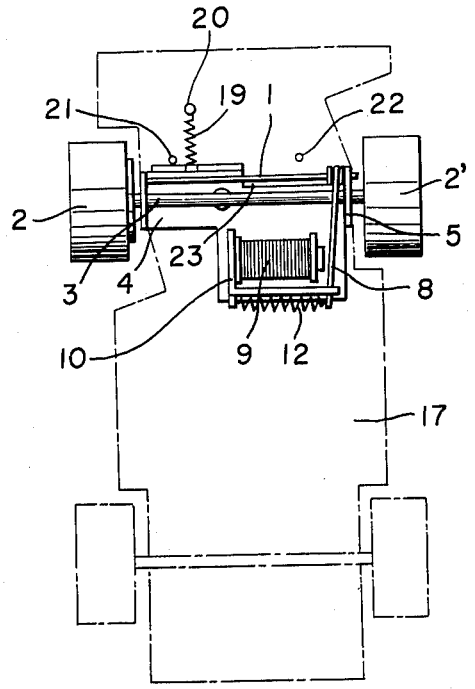
FIG. 1 is a schematic plan view showing a moving toy vehicle provided with the direction changing device embodied by the present invention, wherein an operating rod is not in operation.
Figure 2:
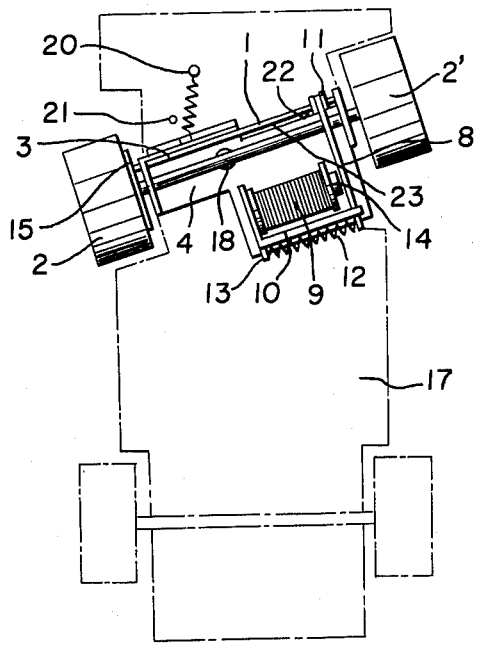
FIG. 2 shows the plan view of FIG. 1 but with the operating rod in operation, the toy vehicle moving toward the left side.
Figure 3:
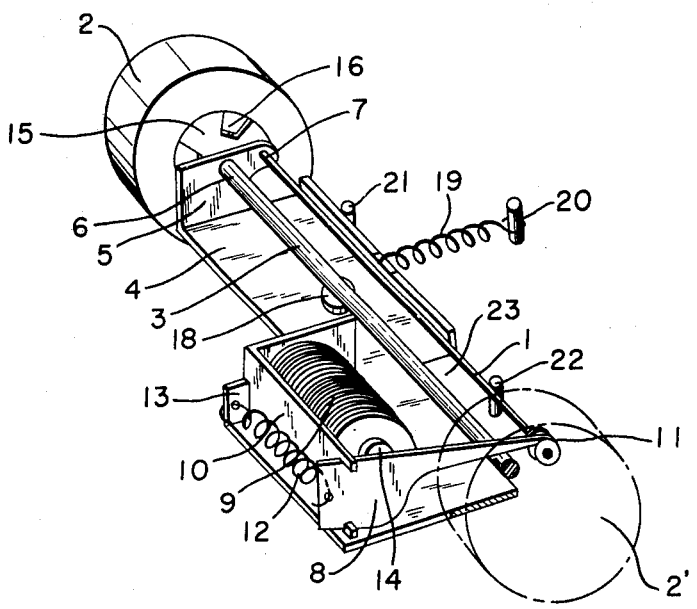
FIG. 3 is a perspective view of the direction changing device according to the present invention.

Referring now to FIGS. 1 to 3 inclusive, the preferred embodiment of the direction changing device according to the present invention comprises an operating rod 1, left and right wheels 2 and 2', a wheel axle 3, a base plate 4, a supporting member 5 provided at both ends of the base plate 4 and formed therein with an axle hole 6 for the wheel axle and a receiving hole for the operating rod 7, a movable iron piece 8 fixed at one end of the operating rod, an electromagnet 9 having an iron core 14 and mounted on one part of the base plate 4, fitting frame 10 for an electromagnet 9, a fixing member 11 for the movable iron piece 8, an operating rod spring 12, a spring receiving piece 13, an engaging disc 15 having a plurality or recessed portions 16, a center shaft or pivot pin 18 to be a center of rotation of the base plate 4, a base plate spring 19, a stopper pin 20 for the spring 19, and stopper pins 21 and 22 for controlling the position of the base plate 4.

The above-enumerated component parts are assembled and constructed in the contemplated direction changing device in an interrelated manner, as follows:

The operating rod 1 is movably held in the receiving hole 7 which is formed in contiguity to the axle hole 6 in the supporting member 5 provided at both ends of the base plate 4 constituting a front wheel fitting device in parallel with the wheel axle. The wheel axle is provided at both ends thereof with front wheels 2 and 2'. The front wheel 2 is fixed at the left side end of the wheel axle to constitute the left wheel, while the front wheel 2' is movably fitted at the right end side of the wheel axle to constitute the right wheel. The movable iron piece 8 in the form of a small letter *h* is loosely held at its lower end part on the fitting frame 10 for accommodating therein the electromagnet 9 to be mounted on one part of the base plate 4, and its top end part is fixed near the right end side of the operating rod 1 by means of the fixing member 11. The above mentioned lower end part of the *h*-shaped movable iron piece is biased toward the spring receiving piece 13 provided at one part of the electromagnet fitting frame 10 through a spring 12 for controlling the operating rod 1 to be away from an iron core 14 of the electromagnet when it is not energized. The left wheel 2 is provided, in its inside, with the engaging disc 15 having appropriate recessed portions therein to receive the left end of the operating rod 1 so that it may be engaged with any one of the recessed portion of the engaging disc. The disc is also axially fixed on the wheel axle 3 so as to be concentrical and integral with the front left wheel 2. A reference numeral 17 designates a vehicle body or chassis of an ordinary toy car shown in a dot-and-dash line, which is presented herein as an example of the moving vehicle to be controlled by the direction changing device of the present invention. On this vehicle body or chassis, there should be provided a signal receiving device, an electric motor, a power transmission mechanism to drive the rear wheels, and so forth, although these components are omitted from the illustration for the sake of simplicity, and, moreover, since they are not necessary to understand the present invention. At the center part of the base plate 4, there is provided the center shaft or pivot pin 18, by which the base plate 4 is made pivotally movable on the vehicle body 17 to change the moving direction. The spring 19, for the base plate 4 is hooked at one end thereof to the stopper pin 20 provided on the vehicle body 17, and at the other end thereof to the front left part of the base plate 4. Both stopper pins 21 and 22 for controlling the position of the base plate are disposed on the vehicle body 17. A reference numeral 23 designates an L-shaped notched part formed at the front right half of the base plate 4. The actual interrelated function of this base plate spring 19, stopper pins 21 and 22, and notched part 23 in the base plate will be explained later.

There will now be described the function of the direction changing device according to the present invention.

First of all, when the toy is to be directed to a travelling direction different from the one before, an operating signal may be emitted from a signal emitting device, whereupon the emitted signal is received by a signal receiving and direction controlling device installed in the body of the toy vehicle, and magnetic force is generated in the electromagnet 9. Incidentally, the signal emitting device to remote-control the electromagnet and the signal receiving device to receive electromagnetic wave radiated from the signal emitting device are omitted from explanations, since it is already known that when a magnetic force is generated in the electromagnet 9, the movable iron piece 8, the one end part opposite to that fixed on the operating rod 1 of which has so far been in a state of being separated from the iron core 14 by the pulling action of the operating rod spring 12, is attracted to the iron core 14, whereupon the operating rod 1, to the right hand part of which the top end of the movable iron piece 8 is connected, moves leftward and the left end thereof is engaged with any one of the concaved or recessed portions of the engaging disc 15 provided inside of the left wheel 2 in its rotation. By this engagement of the operating rod 1 with the engaging disc 15, the wheel 2 rotating in unison with the engaging disc 15 is prevented from its rotation to assume a slipping condition. At this time, the base plate 4 momentarily moves in the counterclockwise direction of the vehicle body 17 on the pivot of the center shaft or pivot pin 18. However, as the L-shaped notch 23 formed at the front right part of the base plate 4 collides with the base plate control pin or stopper pin 22, the base plate 4 stops at this collided position (see FIG. 2). While the left wheel 2 is still being in its stopped state, the right wheel 2: on the opposite side of the left wheel 2 is still continuing its rotation, so that the body of the toy is prevented from its straight movement, and forced to change its direction leftward with the left wheel 2, which stops its rotation and is in its slipping state, as the center of the direction changing.

Next, for this direction changing to be ceased, emission of the operating signal may be stopped, whereupon the movable iron piece 14 loses its magnetic force and the movable iron piece 8 is brought back to a state of being separated from the iron core 14 by the force of the operating rod spring 12, followed by an action which is reverse to the previous engaging action of the operating rod 1 connected to the operating rod spring 12. That is, the tip end of the operating rod 1 disengages from the recessed portion 16 formed in the engaging disc 15, and the left wheel 2, which has been kept in the state of stoppage of rotation, starts again. At the same time, the base plate 4 is pulled forward by the base plate spring 19 and is stopped by colliding with the base plate receiving pin or stopper pin 21 (see FIG. 1), whereby the toy body travels again in the straight direction.

In the foregoing explanations, a case of toy car has been referred to as an example of the device to be controlled. However, the present invention is not so limited to such toy car, but has wide applications in various moving toys such as, for example, dolls, toy animals, and so on. In this connection, it should be understood that any change and modification may be made to the present invention by those skilled in the art without departing from the spirit and scope of the present invention as set forth in the appended claims.

What I claim is:

1. A direction changing and steering device for a moving toy to be operated by a wireless remote-control device, which comprises in combination: a base plate having two end parts, said end parts being bent upright to define axle supporting members, a wheel axle having two ends, wheels fixed at said two ends and passing through and being held by said axle supporting members of said base plate in a rotatable manner, an engaging disc having an inside surface with a plurality of recessed portions, said disc being fixed coaxially with and in one of said wheels so that said disc may not be rotated in idle, while the other wheel is made freely rotatable in idle, an operating rod arranged in parallel with said wheel axle in a laterally slidable manner through said upright end parts of said base plate so that one of the end parts thereof may be properly engaged with any one of the recessed portions in said engaging disc, when said operating rod is caused to move laterally, an electromagnet mounted on one part of said base plate, and a movable iron piece having two ends, one end of which is fixed on said other end of said operating rod and the other end of said movable iron piece is oscillatably supported in the vicinity of said electromagnet so as to cause the operating rod to shift sidewise, when said movable iron piece is attracted to and contacted with the iron core of said electromagnet, a pivot pin, said base plate being oscillatably fitted on the body of said moving toy by said pivot pin to enable said toy to change its moving direction on the pivot of the wheel, the rotation of said wheel being prevented by the operating rod engaged at its one tip end with said one of the recessed portions of said engaging disc provided inside of the wheel, when said movable iron piece contacts the iron core of said electromagnet by a control signal emitted from the outside.

2. The direction changing device as claimed in claim 2, wherein a pair of stopper pins are disposed in front of said base plate to hinder excessive oscillation of said base plate on the pivot pin.

3. The direction changing device as claimed in claim 2, wherein said base plate is provided with a notched portion to be engaged with one of said pair of stopper pins to prevent excessive oscillation thereof.

4. The direction changing device as claimed in claim 1, which includes: a spring, and in which said movable iron piece is biased by said spring at its oscillatably supported other end in a direction opposite to the direction of said operating rod moving into said engaged disc when said iron piece is attracted by said electromagnet in energized condition.

5. The direction changing device as claimed in claim 2, wherein said base plate at one side portion thereof is hooked to and biased by a spring so that it may be constantly in contact with one of said stopper pins to secure straight movement of said toy body, when said operating rod is not actuated.

* * * * *